US008940672B2

(12) United States Patent
Bugner et al.

(10) Patent No.: US 8,940,672 B2
(45) Date of Patent: Jan. 27, 2015

(54) GRAPHITE-FREE HIGH-TEMPERATURE LUBRICANT

(75) Inventors: Steffen Bugner, Budenheim (DE); Ralf Giskow, Mainz (DE); Bernd Schneider, Wiesbaden (DE)

(73) Assignee: Chemische Fabrik Budenheim KG, Budenheim (DE)

( * ) Notice: Subject to any disclaimer, the term of this patent is extended or adjusted under 35 U.S.C. 154(b) by 1705 days.

(21) Appl. No.: 12/308,440

(22) PCT Filed: Jun. 22, 2007

(86) PCT No.: PCT/EP2007/056260

§ 371 (c)(1),
(2), (4) Date: Aug. 9, 2010

(87) PCT Pub. No.: WO2008/000700

PCT Pub. Date: Jan. 3, 2008

(65) Prior Publication Data

US 2010/0298181 A1 Nov. 25, 2010

(30) Foreign Application Priority Data

Jun. 28, 2006 (DE) ..... 10 2006 030 113

(51) Int. Cl.
*C10M 169/04* (2006.01)
*C10N 50/08* (2006.01)

(52) U.S. Cl.
CPC ..... *C10M 169/04* (2013.01); *C10M 2201/085* (2013.01); *C10M 2201/0853* (2013.01); *C10M 2201/087* (2013.01); *C10M 2207/122* (2013.01); *C10M 2207/126* (2013.01); *C10N 2210/01* (2013.01); *C10N 2210/02* (2013.01); *C10N 2220/082* (2013.01); *C10N 2230/08* (2013.01); *C10N 2230/40* (2013.01); *C10N 2240/402* (2013.01); *C10N 2240/403* (2013.01); *C10N 2250/08* (2013.01)
USPC ..... 508/158

(58) Field of Classification Search
USPC ..... 508/158
See application file for complete search history.

(56) References Cited

U.S. PATENT DOCUMENTS

| | | | | |
|---|---|---|---|---|
| 4,710,307 | A * | 12/1987 | Periard et al. | 252/79 |
| 5,158,694 | A * | 10/1992 | Waynick | 508/163 |
| 2002/0115573 | A1 | 8/2002 | Hei et al. | |

FOREIGN PATENT DOCUMENTS

| | | | | |
|---|---|---|---|---|
| DE | 850051 | C | | 9/1952 |
| DE | 292678 | A5 | | 10/1983 |
| EP | 0303734 | B1 | | 2/1989 |
| EP | 0334977 | A1 | | 10/1989 |
| EP | 0829528 | A2 | * | 3/1998 |
| EP | 0829528 | B1 | | 3/1998 |
| EP | 1816184 | A1 | | 8/2007 |
| JP | 54008261 | A | | 1/1979 |
| JP | 07048589 | A | | 2/1995 |
| JP | 2000202508 | A | * | 7/2000 |
| JP | 2000202508 | A | | 7/2000 |
| RU | 2017799 | C1 | | 8/1994 |

OTHER PUBLICATIONS

Machine Transaltaion of EP 0829528A2.*
Derwent Translation of JP 2000202508A.*

* cited by examiner

*Primary Examiner* — Prem C Singh
*Assistant Examiner* — Ming Cheung Po
(74) *Attorney, Agent, or Firm* — Michael L. Dunn

(57) ABSTRACT

A high-temperature lubricant for the hot processing of metals comprising a mixture of fine-powder materials. To provide a high-temperature lubricant having good trickle and flow characteristics for dissolving scale on heated metal surfaces, which applied in powder form permits good coverage of the metal surface and which even after prolonged storage under production conditions still has good trickle and flow characteristics without severe lump formation and which avoids the use of graphite, in accordance with the invention it is proposed that the mixture includes at least the following constituents (a) a secondary and/or tertiary calcium phosphate compound, (b) a fatty acid or a fatty acid salt, (c) boric acid, a boric acid salt (borate) and/or a mineral containing boric acid salt (borate), and (d) condensed alkali metal phosphates, and wherein the constituents of the mixture have a mean grain size of ≤150 μm and the lubricant does not contain any addition of graphite.

16 Claims, No Drawings

GRAPHITE-FREE HIGH-TEMPERATURE LUBRICANT

BACKGROUND OF THE INVENTION

The present invention concerns a high-temperature lubricant for the hot processing of metals.

In the hot working of metals, in particular steel, in a temperature range of 700-1300° C., scale formation occurs at the heated metal surface, at the ambient air. In the case of hot rolling methods for steel for the production of seamless tubes and pipes, a solid material is pierced and a hollow block formed, which is then elongated in subsequent rolling steps. Here the danger of scale formation on the heated metal surface of the hollow block during transfer to the elongation procedure is particularly high. In the subsequent rolling steps that occurrence of scale can lead to internal flaws in the seamless tube or pipe. For that reason the scale involved is blown off for example with compressed air or inert gas. In addition very widely differing substances in powder form are applied as lubricants or mordant agents to the inside surface of the hollow blocks. Examples of such lubricants or mordant agents contain graphite, boron nitride, molybdenum sulphide, silicates or alkaline earth phosphates and mixtures thereof.

Many lubricants for the hot working of metals contain graphite by virtue of its good lubricating properties. It will be noted however that graphite suffers from considerable disadvantages such as for example the absorption of graphite carbon into the worked metal surface, whereby the composition and the properties of the metal surface can be altered. In addition graphite is undesirable for reasons relating to working hygiene as the graphite powder is easily atomised into the ambient atmosphere and represents a health risk by breathing in the graphite powder for people working in the vicinity.

Furthermore by virtue of their physical properties and grain sizes many known lubricants do not have good trickle and flow characteristics. A coarse material involving large grain sizes frequently results in inadequate and irregular covering of the metal surface and thus poor scale reduction. Known fine-grain materials of small grain sizes, for example less than 50 μm frequently have a tendency to form lumps, in particular upon storage, and for that reason it is only with difficulty that they can be sprayed in powder form onto the metal surface. A finer grain size however would afford the advantage that better layer formation can be achieved, but that advantage in known compositions of fine grain size is nullified again by the severe tendency to form lumps.

BRIEF DESCRIPTION OF THE INVENTION

The object of the present invention was therefore that of providing a high-temperature lubricant with good trickle and flow characteristics for dissolving scale on heated metal surfaces, which permits good covering of the metal surface when applied in powder form and which even after prolonged storage under production conditions still has good trickle and flow properties without severe lump formation and which avoids the use of graphite.

According to the invention that object is attained by a high-temperature lubricant for the hot processing of metals comprising a mixture of fine-powder materials, wherein the mixture includes at least the following constituents:

(a) a secondary and/or tertiary calcium phosphate compound, (b) a fatty acid or a fatty acid salt, (c) boric acid, a boric acid salt (borate) and/or a mineral containing boric acid salt (borate), and (d) condensed alkali metal phosphates, and wherein the constituents of the mixture have a mean grain size of ≤150 μm and the lubricant does not contain any addition of graphite.

DETAILED DESCRIPTION OF THE INVENTION

It has surprisingly been found that the mixture according to the invention with the constituents (a), (b), (c) and (d) is particularly well suited as a lubricant for the hot processing of metals. It will be appreciated that the lubricant according to the invention may include further constituents if they do not substantially detrimentally influence the desired advantageous properties.

Secondary and/or tertiary calcium phosphate compounds have surprisingly proven to be particularly suitable trickle flow aids in a high-temperature lubricant of the kind according to the invention for the hot processing of metals. Monocalcium phosphate is unsuitable as it leads to lump formation in the presence of humidity in the air. The calcium phosphate compound of the high-temperature lubricant according to the invention is quite particularly preferably selected from hydroxyapatite ($Ca_5(PO_4)_3OH$) and tricalcium phosphate ($Ca_3(PO_4)_2$), with hydroxyapatite being particularly preferred.

The mixture of the high-temperature lubricant according to the invention further includes a fatty acid or a fatty acid salt in combination with the other constituents. It has surprisingly been found that the use of a fatty acid or a fatty acid salt means that lump formation of the fine-grain powder can be considerably reduced and the capability of withstanding storage can be improved. Without the applicants hereby feeling themselves bound down to a theory, it is assumed that the fatty acid or the fatty acid salt is attached to the grains of one or more further constituents of the mixture and in that way prevents or reduces lump formation of the grains, keeps moisture away from the grains and thereby improves the capacity for withstanding storage as well as the trickle or flow characteristics of the lubricant.

In a preferred embodiment of the high-temperature lubricant according to the invention the fatty acid or the fatty acid salt is selected from saturated and unsaturated fatty acids with 6 to 26 carbon atoms or salts thereof. Particularly preferably the fatty acid or the fatty acid salt is selected from capronic acid, caprylic acid, capric acid, lauric acid, myristic acid, palmitic acid, margaric acid, stearic acid, arachic acid, behenic acid, lignoceric acid, cerotic acid, palmitoleic acid, oleic acid, elaidic acid, vaccenic acid, icosic acid, erucic acid, nervonic acid, linoleic acid, linolenic acid, arachidonic acid, timnodonic acid, clupanodonic acid and salts thereof. Quite particularly preferably the fatty acid or the fatty acid salt is stearic acid or the salt thereof, in particular magnesium stearate. A prerequisite for the selection is that the fatty acid or the fatty acid salt is in the form of a solid at a temperature>30° C.

As a further constituent the high-temperature lubricant according to the invention contains boric acid, a boric acid salt (borate) and/or a mineral containing boric acid salt (borate). Boric acid ($H_3BO_3$), borax ($Na_2B_4O_5(OH)_4.8H_2O$ or $Na_2B_4O_7.10H_2O$), further sodium borates such as $Na_2B_4O_7.5H_2O$, $Na_2B_4O_7$ (water-free), sodium metaborate ($Na_2BO_2.4H_2O$) and boric acid anhydride ($B_2O_3$) are particularly preferred. The use according to the invention of boric acid, a boric acid salt (borate) and/or a mineral containing a boric acid salt (borate) improves uniform distribution of the lubricant on the metal surface and reduces scale formation. At the high temperatures of the metal processing operation the high-temperature lubricant forms a molten material.

As a further constituent the high-temperature lubricant according to the invention contains condensed alkali metal phosphates, preferably condensed sodium or potassium phosphates or mixtures thereof, particularly preferably polyphosphates and/or pyrophosphates and/or metaphosphates or mixtures thereof. Disodium pyrophosphate $Na_2H_2P_2O_7$, trisodium pyrophosphate $Na_3HP_2O_7$, tetrasodium pyrophosphate $Na_4P_2O_7$, sodium tripolyphosphate $Na_5P_3O_{10}$, sodium trimetaphosphate $(NaPO_3)_3$, sodium polyphosphate $(NaPO_3)_n$, dipotassium pyrophosphate $K_2H_2P_2O_7$, tripotassium pyrophosphate $K_3HP_2O_7$, tetrapotassium pyrophosphate $K_4P_2O_7$, potassium tripolyphosphate $K_5P_3O_{10}$, potassium trimetaphosphate $(KPO_3)_3$ and/or potassium polyphosphate $(KPO_3)_n$ are quite particularly preferred, with sodium tripolyphosphate $Na_5P_3O_{10}$ being most preferred. It has been found that the use of a polyphosphate and/or a pyrophosphate and/or a metaphosphate in the mixture of the high-temperature lubricant according to the invention advantageously contribute inter alia to scale dissolution.

In the high-temperature lubricant according to the invention the constituents of the mixture have a mean grain size of ≤150 μm. A mean grain size of the constituents of the mixture of ≤100 μm is preferred, a mean grain size of ≤50 μm being particularly preferred. The low mean grain sizes of the constituents of the mixture according to the invention provide that the trickle and flow characteristics of the high-temperature lubricant according to the invention are considerably improved in comparison with known lubricants, spraying onto surfaces in the form of powder is easier and better and more uniform layer formation or coating on the metal surface is guaranteed. At the same time the combination of the constituents according to the invention of the mixture prevents or reduces lump formation which usually occurred in the case of lubricants in accordance with the state of the art of small grain sizes and resulted in serious shortcomings.

It is further preferred if the constituents of the mixture of the high-temperature lubricant according to the invention have a mean grain size of ≥3 μm, preferably ≥10 μm, particularly preferably ≥15 μm. It has been found that excessively small mean grain sizes on the one hand can be produced only with very great difficulty and complication and at comparatively high costs while on the other hand they also increase the tendency to lump formation again. A mean grain size in the range of 20 to 50 μm has therefore proven to be optimum.

In a preferred embodiment of the high-temperature lubricant according to the invention the secondary or tertiary calcium phosphate compound (a) is included in the mixture in an amount of 0.1 to 15% by weight, preferably 0.5 to 10% by weight, particularly preferably from 1 to 5% by weight.

In a further preferred embodiment of the high-temperature lubricant according to the invention the fatty acid or the fatty acid salt (b) is contained in the mixture in an amount of 0.1 to 15% by weight, preferably 1 to 10% by weight, particularly preferably from 3 to 7% by weight.

In a further preferred embodiment of the high-temperature lubricant according to the invention boric acid, boric acid salt (borate) and/or a mineral (c) containing boric acid salt (borate) is contained in the mixture in an amount of 5 to 30% by weight, preferably 10 to 25% by weight, particularly preferably 15 to 20% by weight.

In a further preferred embodiment of the high-temperature lubricant according to the invention polyphosphate and/or pyrophosphate and/or metaphosphate (d) is contained in the mixture in an amount of 60 to 95% by weight, preferably 70 to 85% by weight, particularly preferably 75 to 80% by weight.

Storage tests in respect of various mixtures were carried out under production conditions to test the tendency to lump formation under production conditions. For that purpose 150 g of sample was stored in an air-conditioning cabinet (type 3821/15 from Feutron) at a constant 30° C. and 80% relative air humidity for 0 h, 67 h and 96 h, and then its agglomerate formation (trickle flow capability) was determined in a sieve test and its moisture absorption was determined on the basis of the increase in weight in comparison to the original weighing.

It is only the overall assessment of combined storage and trickle flow characteristics of a respective mixture, that permits information to be afforded about its quality and suitability under production conditions. The results of the investigation on various mixtures are shown in Table 1.

The operation of determining the mean grain size of the mixture or of the constituents of the mixture of the high-temperature lubricant according to the invention is effected by means of a laser granulometer Cilas model 715/920 from Cilas U.S. Inc. About 80 mg of sample is suspended in propan-2-ol and measurement is effected a minute after production of the suspension in accordance with the manufacturers' instructions.

TABLE 1

Trickle flow capability and moisture absorption after different storage periods under production conditions

| Sample number | Composition (% by weight) | Storage period under production conditions: 30° C., 80% rel. air humidity | Sieve residue with mesh or hole size of 250 μm[1)] (%) of initial weighing | Moisture absorption (%) of initial weighing |
|---|---|---|---|---|
| 1 | 82% sodium tripolyphosphate | 0 h | 5 | 0 |
| | 18% boric acid (techn. | 67 h | 89 | 17 |
| | powder) | 96 h | 87 | 20 |
| | (State of the art) | | | |
| 2 | 74% sodium tripolyphosphate | 0 h | 2 | 0 |
| | 16% boric acid (techn. | 67 h | 67 | 11 |
| | powder) | 96 h | 57 | 11 |
| | 5% tricalcium phosphate | | | |
| | 5% magnesium stearate | | | |
| 3 | 72% sodium tripolyphosphate | 0 h | 3 | 0 |
| | 16% boric acid (techn. | 67 h | 73 | 12 |
| | powder) | 96 h | 71 | 10 |
| | 10% tricalcium phosphate | | | |
| | 2% magnesium stearate | | | |

TABLE 1-continued

Trickle flow capability and moisture absorption after different storage periods under production conditions

| Sample number | Composition (% by weight) | Storage period under production conditions: 30° C., 80% rel. air humidity | Sieve residue with mesh or hole size of 250 μm[1)] (%) of initial weighing | Moisture absorption (%) of initial weighing |
|---|---|---|---|---|
| 4 | 72% sodium tripolyphosphate | 0 h | 4 | 0 |
| | 16% boric acid (techn. | 67 h | 59 | 12 |
| | powder) | 96 h | 53 | 8 |
| | 2% tricalcium phosphate | | | |
| | 10% magnesium stearate | | | |
| 5 | 74% sodium tripolyphosphate | 0 h | 16 | 0 |
| | 16% boric acid (techn. | 67 h | 14 | 8 |
| | powder) | 96 h | 13 | 13 |
| | 5% tricalcium phosphate | | | |
| | 5% magnesium stearate | | | |

[1)]Sieve conditions: sample amount 2 g + moisture absorption amount; vibration amplitude 1 scale portion; vibration period 70 secs.

What is claimed is:

1. A high-temperature powder lubricant for the hot processing of metals comprising a mixture of fine-powder materials, wherein the mixture includes at least the following constituents:

(a) 0.1 to 15% by weight of a calcium phosphate compound selected from the group consisting of phosphate secondary calcium phosphate compound, a tertiary calcium phosphate compound and mixtures thereof, (b) 0.1 to 15% by weight of a compound selected from the group consisting of fatty acids and fatty acid salts that are solid at a temperature greater than 30° C., (c) 5 to 30% by weight of a compound selected from the group consisting of boric acid, boric acid salt (borate), a mineral containing boric acid salt (borate) or mixtures thereof, and (d) 60 to 95% by weight of a compound selected from the group consisting of condensed sodium phosphate, condensed potassium phosphate and mixtures thereof, wherein, the constituents of the mixture have a mean grain size of ≤150 μm and the lubricant is graphite free.

2. The high temperature lubricant of claim 1 wherein the constituents are:

(a) hydroxyapatite ($Ca_5(PO_4)_3OH$) or tricalcium phosphate ($Ca_3(PO_4)_2$), (b) saturated and unsaturated fatty acids with 6 to 26 carbon atoms, (c) boric acid ($H_3BO_3$), borax ($Na_2B_4O_5(OH)_4.8H_2O$ or $Na_2B_4O_7.10H_2O$), $Na_2B_4O_7.5H_2O$, $Na_2B_4O_7$ (water-free), sodium metaborate ($Na_2BO_2.4H_2O$), boric acid anhydride ($B_2O_3$) or mixtures thereof, and (d) condensed sodium phosphate, condensed potassium phosphates or mixtures thereof.

3. The high temperature lubricant of claim 1 wherein the constituents are:

(a) hydroxyapatite ($Ca_5(PO_4)_3OH$), (b) capronic acid, caprylic acid, capric acid, lauric acid, myristic acid, palmitic acid, margaric acid, stearic acid, arachic acid, behenic acid, lignoceric acid, cerotic acid, palmitoleic acid, oleic acid, elaidic acid, vaccenic acid, icosic acid, erucic acid, nervonic acid, linoleic acid, linolenic acid, arachidonic acid, timnodonic acid, clupanodonic acid and salts thereof, provided that the fatty acid or the fatty acid salt is present as a solid at a temperature >30°, (c) boric acid ($H_3BO_3$), borax ($Na_2B_4O_5(OH)_4.8H_2O$ or $Na_2B_4O_7.10H_2O$), $Na_2B_4O_7.5H_2O$, $Na_2B_4O_7$ (water-free), sodium metaborate ($Na_2BO_2.4H_2O$), boric acid anhydride ($B_2O_3$) or mixtures thereof, and (d) disodium pyrophosphate ($Na_2H_2P_2O_7$), trisodium pyrophosphate ($Na_3HP_2O_7$), tetrasodium pyrophosphate ($Na_4P_2O_7$), sodium tripolyphosphate ($Na_5P_3O_{10}$), sodium trimetaphosphate ($(NaPO_3)_3$), sodium polyphosphate ($(NaPO_3)_n$), dipotassium pyrophosphate ($K_2H_2P_2O_7$), tripotassium pyrophosphate ($K_3HP_2O_7$), tetrapotassium pyrophosphate ($K_4P_2O_7$), potassium tripolyphosphate ($K_5P_3O_{10}$), potassium trimetaphosphate ($(KPO_3)_3$), potassium polyphosphate ($(KPO_3)_n$) or mixtures thereof.

4. A high-temperature lubricant according to claim 1 wherein constituent (d) is sodium tripolyphosphate ($Na_5P_3O_{10}$).

5. A high-temperature lubricant according to claim 1 wherein the fatty acid or the fatty acid salt is stearic acid or a salt thereof.

6. The high temperature lubricant of claim 1 wherein the secondary or tertiary calcium phosphate compound (a) is contained in the mixture in an amount of 0.5 to 10% by weight.

7. A high-temperature lubricant according to claim 1 wherein the secondary or tertiary calcium phosphate compound (a) is contained in the mixture in an amount of 1 to 5% by weight.

8. A high-temperature lubricant according to claim 1 wherein the fatty acid or the fatty acid salt (b) is contained in the mixture in an amount of 1 to 10% by weight.

9. A high-temperature lubricant according to claim 1 wherein the fatty acid or the fatty acid salt (b) is contained in the mixture in an amount of 3 to 7% by weight.

10. A high-temperature lubricant according to claim 1 wherein the boric acid, a boric acid salt (borate), a mineral containing boric acid salt (borate) or mixtures thereof is contained in the mixture in an amount of 10 to 25% by weight.

11. A high-temperature lubricant according to claim 1 wherein the boric acid, a boric acid salt (borate), a mineral containing boric acid salt (borate) or mixtures thereof is contained in the mixture in an amount of 15 to 20% by weight.

12. A high-temperature lubricant according to claim 1 wherein the polyphosphates, pyrophosphates, metaphosphates or mixtures thereof (d) is contained in the mixture in an amount of 70 to 85% by weight.

13. A high-temperature lubricant according to claim 1 wherein the condensed sodium phosphate, condensed potassium phosphate or mixtures thereof (d) is contained in the mixture in an amount of 75 to 80% by weight.

14. A high-temperature lubricant according to claim 1 wherein the constituents of the mixture have a mean grain size of ≥3 μm to ≤100 μm.

15. A high-temperature lubricant according to claim 1 wherein the constituents of the mixture have a mean grain size of ≥10 μm to ≤50 μm.

16. A high-temperature lubricant according to claim 1 wherein the constituents of the mixture have a mean grain size of ≥15 μm.

* * * * *